US006768478B1

(12) United States Patent
Wani et al.

(10) Patent No.: US 6,768,478 B1
(45) Date of Patent: Jul. 27, 2004

(54) DRIVING METHOD OF AC TYPE PLASMA DISPLAY PANEL

(75) Inventors: Koichi Wani, Osaka-fu (JP); Kazunori Hirao, Osaka-fu (JP); Koji Aoto, Osaka-fu (JP); Yoshihito Tahara, Osaka-fu (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 178 days.

(21) Appl. No.: 09/670,615

(22) Filed: Sep. 27, 2000

(30) Foreign Application Priority Data

Sep. 28, 1999 (JP) ..... 11-274202

(51) Int. Cl.[7] ..... G09G 3/28

(52) U.S. Cl. ..... 345/60; 345/37; 345/67; 315/169.1; 315/169.4

(58) Field of Search ..... 345/60, 67, 68, 345/36, 37, 40–41

(56) References Cited

U.S. PATENT DOCUMENTS

| | | | | |
|---|---|---|---|---|
| 5,745,086 A | | 4/1998 | Weber | |
| 5,835,072 A | * | 11/1998 | Kanazawa | 345/60 |
| 5,952,986 A | | 9/1999 | Nguyen et al. | |
| 6,034,482 A | * | 3/2000 | Kanazawa et al. | 315/169.4 |
| 6,262,700 B1 | * | 7/2001 | Ueoka | 345/68 |
| 6,295,040 B1 | * | 9/2001 | Nhan et al. | 345/60 |
| 6,404,411 B1 | * | 6/2002 | Masuda et al. | 345/66 |
| 6,414,654 B1 | * | 7/2002 | Makino | 345/60 |
| 6,707,436 B2 | * | 3/2004 | Setoguchi et al. | 345/60 |
| 2001/0013845 A1 | * | 8/2001 | Hirakawa | 345/60 |
| 2002/0030644 A1 | * | 3/2002 | Ishii et al. | 345/67 |
| 2002/0122017 A1 | * | 9/2002 | Mikoshiba et al. | 345/66 |
| 2002/0167466 A1 | * | 11/2002 | Setoguchi et al. | 345/60 |

FOREIGN PATENT DOCUMENTS

| | | |
|---|---|---|
| JP | 5-121006 | 5/1993 |
| JP | 9-68944 | 3/1997 |

* cited by examiner

*Primary Examiner*—Richard Hjerpe
*Assistant Examiner*—Kimnhung Nguyen
(74) *Attorney, Agent, or Firm*—Wenderoth, Lind & Ponack, L.L.P.

(57) ABSTRACT

The object of the present invention is to provide a method of driving of an AC type plasma display panel with higher emitting efficiency without increasing the external-sustain voltage $V_{SUS}$, even if the discharge sustain gap $d_p$ is extended.

An AC type plasma display panel according to the present invention comprises a first and second substrates arranged opposite to each other. The first substrate includes a plurality pairs of a first and second electrodes extending parallel each other, and a dielectric layer covering thereon. The second substrate includes a plurality of third electrodes extending in a direction crossing the first and second electrodes, and a plurality of partition walls between each third electrode. A method of the panel according to the present invention comprises applying a voltage so that the discharge generated in the first opposing discharge space progresses towards a second opposing discharge space and extends along the third electrode. Therefore, the positive column discharge can be achieved so that the high emission efficiency can be realized.

24 Claims, 7 Drawing Sheets

DRIVING METHOD OF AC TYPE PLASMA DISPLAY PANEL

BACKGROUND OF THE INVENTION

1) Technical Field of the Invention

This invention relates to a driving method of an AC type plasma display panel.

2) Description of Related Arts

FIG. 8A shows a cross sectional view of a conventional AC type surface discharge plasma display panel 1 (referred to as the "conventional panel" hereinafter), and FIG. 8B shows an another cross sectional view taken along line A—A in FIG. 8A.

As shown in FIGS. 8A and 8B, the conventional panel 1 comprises, in general, a forward substrate 3 and a back substrate 4, both made of glass, opposing to each other through a discharge space 2.

The forward substrate 3 includes a plurality of scan electrodes 7 and sustain electrodes 8, arranged parallel to each other on the lower surface thereof. A dielectric layer 5 covers across the lower surface and the scanning and sustain electrodes 7, 8 as well. A protective layer 6 covers on the dielectric layer 5. The scan electrode 7 and the sustain electrode 8 are made of transparent electrodes 7*a*, 8*a* and metal bus 7*b*, 8*b* for enhancing conductivities of the electrodes.

The back substrate 4 includes a plurality of data electrodes 9 on the upper surface thereof, and a plurality of partition walls partitioning each data electrode 9. The back substrate 4 further includes fluorescent layer provided on the upper surface thereof, the data electrodes 9, and the sides of the partition walls 10. The forward and back substrates 3, 4 are arranged so that the scan electrodes 7 and the sustain electrodes 8 oppose orthogonally to data electrodes 9. Thus, a plurality of linear discharge spaces 2 are defined by the forward and back substrates 3, 4 and a plurality of partition walls 10.

Gas such as neon, xenon, or the mixture thereof is filled in the discharge space 2, which allows to emit ultraviolet rays in accordance with the electric discharge (referred to as simply "discharge" hereinafter).

In such a panel 1, an external-sustain voltage $V_{SUS}$ is alternately applied on each of the scan electrode 7 and the corresponding sustain electrode 8 so as to cause gas in the discharge space 2 to emit ultraviolet rays when the discharge is generated, thereby to excite the fluorescent layer to transform ultraviolet rays into visual rays.

This is a conventional mechanism for displaying as a plasma display panel, and such a discharge is referred to as a "display discharge". The display discharge is also referred to as the "surface discharge" generated between the scan electrode 7 and the sustain electrode 8. A distance between the scan electrode 7 and the sustain electrode 8 is determined so that an external-sustain voltage $V_{SUS}$ that can sustain the discharge therebetween is minimized. The distance is referred to as a "discharge sustain gap $d_p$".

According to the currently available conventional panel, in case where gas within the discharge space 2 has a pressure in the range of about 50 to 60 kPa, and the discharge sustain gap $d_p$ falls within the range of 80 to 100 $\mu$m, then the external-sustain voltage $V_{SUS}$ is minimized to 180 to 200V. In that case, it is known that the maximum emitting efficiency can be obtained where the partial pressure of xenon gas is 5 to 10% of the total pressure.

However, the conventional panel yet has an insufficient emitting efficiency in comparison with other displays such as CRTs. For example, the aforementioned panel has the maximum emitting efficiency of approximately 11 m/W, which is one-fifth of that of CRTs.

It is well known that the longer discharge sustain gap $d_p$ enhances the emitting efficiency, but increases the external-sustain voltage $V_{SUS}$. Eventually, it is difficult to drive such a panel with higher emitting efficiency.

SUMMARY OF THE INVENTION

This invention is ad dressed to this problem and has an object to provide an AC type plasma display panel with higher emitting efficiency without increasing the external-sustain voltage $V_{SUS}$, even if the discharge sustain gap $d_p$ is extended, as well as a method of driving the same.

In a driving method of an AC type plasma display panel according to the first aspect of the present invention, the AC type plasma display panel comprises: a first substrate including a plurality pairs of a first and second electrodes extending parallel to each other on a first surface, and a dielectric layer covering across the first surface and on the first and second electrodes; and a second substrate including a plurality of third electrodes extending on a second surface in a direction crossing the first and second electrodes, and a plurality of partition walls partitioning each third electrode from another; wherein said first and second substrates are arranged so that the first and second surfaces oppose to each other; and said driving method comprising: driving said AC type plasma display panel so that the discharge generated in a first opposing discharge space between a first and third electrodes moves towards a second opposing discharge space between a second and third electrodes, and extends along the third electrode. Therefore, the positive column discharging can be achieved so that the high emission efficiency can be obtained.

In the driving method of the AC type plasma display panel, said AC type plasma display panel further comprises a blue, green, and red fluorescent layers provided on the third electrodes between adjacent partition walls, emitting a blue, green, and red visual rays, respectively, in accordance with ultraviolet rays generated by the discharge; and at least one of widths between the adjacent partition walls provided with the blue, green, and red fluorescent layers are different from others. Therefore, any desirable color light can be obtained.

In the driving method of the AC type plasma display panel, the adjacent partition walls provided with the blue fluorescent layer have the width greater that those provided with green and red fluorescent layers. Therefore, a color temperature of a white light can be adjusted by selecting the widths between the adjacent partition walls.

In a driving method of an AC type plasma display panel according to the second aspect of the present invention, the AC type plasma display panel comprises: a first substrate including a plurality pairs of a first and second electrodes extending parallel to each other on a first surface, and a dielectric layer covering across the first surface and on the first and second electrodes; and a second substrate including a plurality of third electrodes extending on a second surface in a direction crossing the first and second electrodes, and a plurality of partition walls partitioning each third electrode from another; wherein said first and second substrates are arranged so that the first and second surfaces oppose to each other; said driving method comprises the steps of: a) applying a predetermined voltage between the first and second electrodes so that the second electrode is positively biased relative to the first electrode, and applying a data pulse voltage to the third electrode during an address period; and b) applying voltages during an sustain period so that after the discharge begins in a second opposing discharge space between the second and third electrodes, it moves towards a first opposing discharge space between the first and third electrodes, and extends along the third electrode. Therefore, the AC type plasma display panel can be driven with reduced discharging voltages in a stable way.

The driving method of the AC type plasma display panel, further comprises the step of: c) applying voltages so that after the discharge begins in the first opposing discharge space, it moves towards the second opposing discharge space, and extends along the third electrode.

In the driving method of the AC type plasma display panel, said step b) and said step c) are repeatedly and alternately performed so as to sustain the discharge.

In the driving method of the AC type plasma display panel, the voltages applied during the sustain period are less than the minimum voltage necessary for generating a surface discharge between the first and second electrodes.

The driving method of the AC type plasma display panel, further comprises the step of: d) applying a signal voltage with a gradually varying inclined portion to the first, second, or third electrode during an initialize period prior to the address period.

In the driving method of the AC type plasma display panel, the inclined portion has a varying rate of 10 V/$\mu$s or less.

Further scope of applicability of the present invention will become apparent from the detailed description given hereinafter. However it should be understood that the detailed description and specific examples, while indicating preferred embodiments of the invention, are given by way of illustration only, since various changes and modifications within the sprit and scope of the invention will become apparent to those skilled in the art from this detailed description.

BRIEF DESCRIPTION OF THE DRAWINGS

The present invention become more fully understood from the detailed description given hereinafter and accompanying drawings which are given by way of illustration only, and thus are not limitative of the present invention and wherein.

DETAILED DESCRIPTION OF THE PREFERRED EMBODIMENTS

Figure 1:
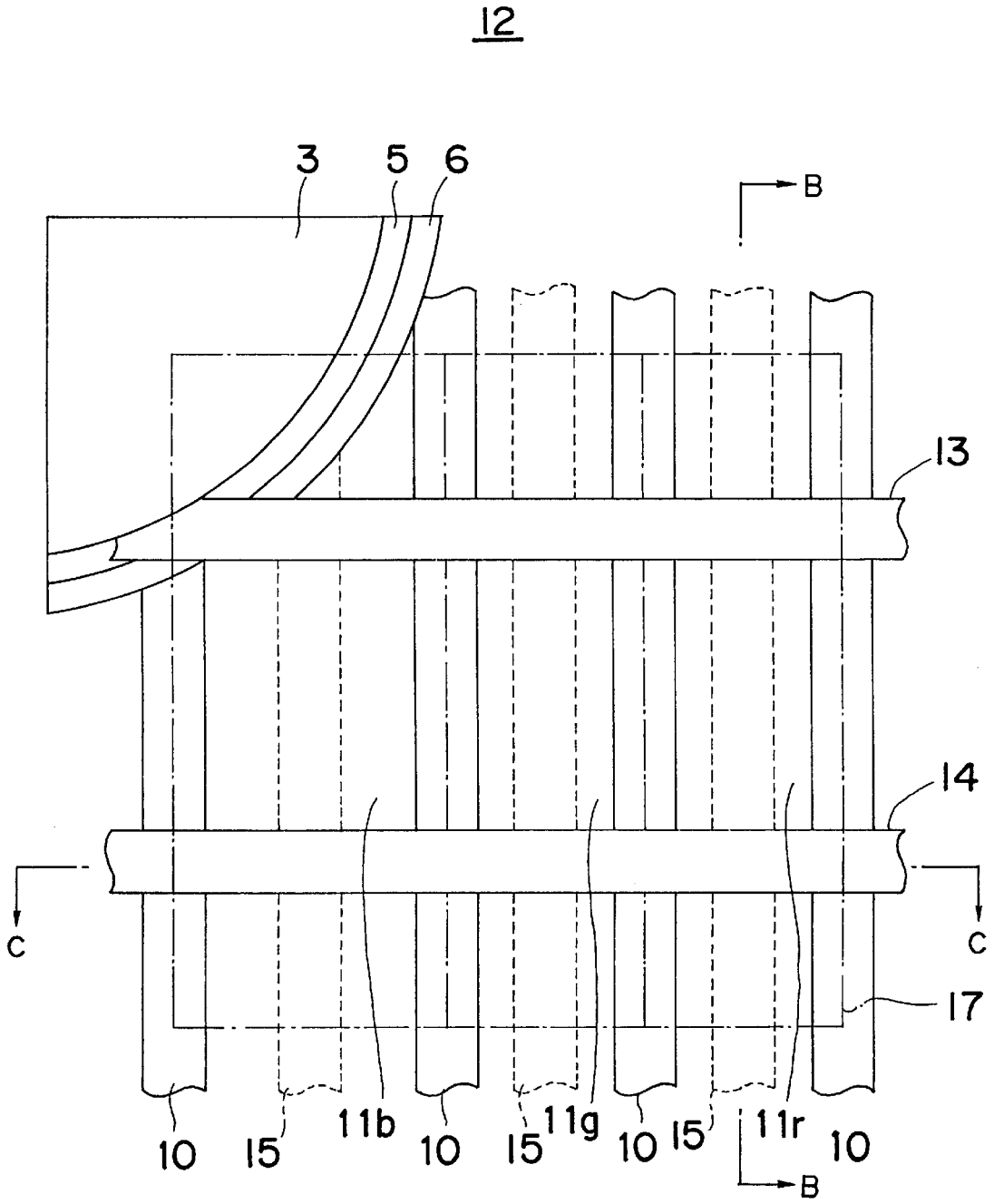
FIG. 1 is a partially fragmentary top view of the panel according to an embodiment of the present invention.
Figure 2:
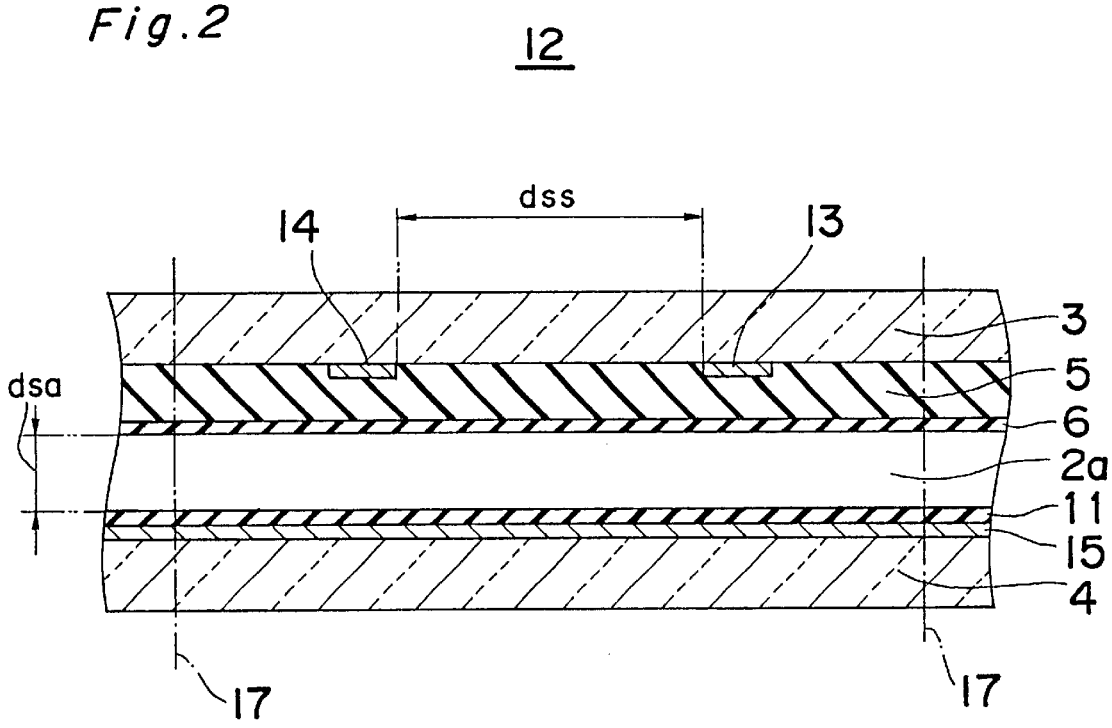
FIG. 2 is a cross sectional view of the panel taken along a line B—B in FIG. 1.

Referring to attached drawings, an AC type plasma display panel according to one embodiment of the present invention will be described hereinafter. FIG. 1 shows a partially exposed top plan view of an AC type plasma display panel (referred to as simply a "panel"). FIG. 2 shows a cross sectional view taken along line B—B in FIG. 1, and FIG. 3 shows a cross sectional view taken along line C—C in FIG. 1

Figure 3:
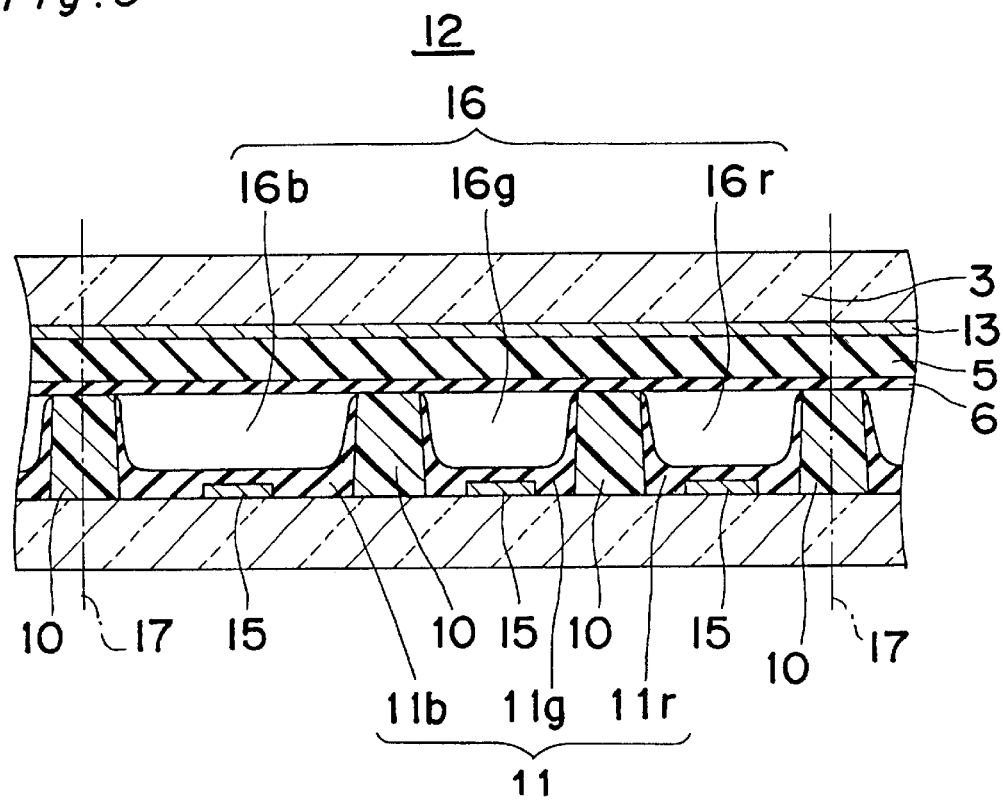
FIG. 3 is a cross sectional view of the panel taken along a line C—C in FIG. 1.

As shown in FIGS. 1 to 3, the panel 12 according to this embodiment of the present invention comprises, in general, a forward substrate 3 and a back substrate 4, which are both made of glass, opposing each other and intervened with an discharge space 2*a*.

The forward substrate 3 includes a plurality pairs of stripe-like first and second electrodes 13 and 14, arranged parallel to each other on the lower surface thereof. A dielectric layer 5 covers across the lower surface and the first electrodes 13 and second electrodes 14 as well. Also, a protective layer 6 made of material such as magnesium oxide (MgO) that has a high secondary electron emission coefficient is provided on the dielectric layer 5. The secondary electron emission represents a phenomenon where a solid material on which electrons have been impinged by primary electrons emits another secondary electrons therefrom. The material such as MgO produces more secondary electrons than primary electrons.

The back substrate 4 includes a plurality of stripe-like third electrodes 15 on the upper surface, which opposes to and crosses the first and second electrodes 13 and 14, and a plurality of partition walls 10 formed between the third electrodes 15. Thus, a plurality of linear discharge spaces 2*a* are defined and surrounded by the forward and back substrates 3, 4 and a plurality of partition walls 10. The back substrate 4 further includes a fluorescent layer 11 provided on the upper surface thereof, the third electrodes 15, and the sides of the partition walls 10.

A mixture of gases containing xenon (Xe) and one of gas selected from the group consisting of helium (He), neon (Ne), and argon (Ar) is filled within the discharge space 2*a*, which allows to emit ultraviolet rays in accordance with the electric discharge (referred to as simply "discharge" hereinafter).

The panel 12 displays an image that can be seen from the side of the forward substrate 3. The discharge causes mixture of gases in the discharge space 2*a* to emit ultraviolet rays which are transformed by the fluorescent layer 11 into visual rays.

So far, although it has been discussed that the fluorescent layer 11 to be made of a single material, three different fluorescent layers capable of emitting lights of three different colors such as red, green, and blue can be used in this instance. As shown in FIG. 1, a blue, green, and red fluorescent layers 11*b*, 11*g*, and 11*r* are arranged, respectively, extending along and between the partition walls 10. Also, as shown in FIG. 3, a blue, green, and red discharge cells 16*b*, 16*g*, and 16*r* is provided with the blue, green, and red fluorescent layers 11*b*, 11*g*, and 11*r*, respectively. Each discharge cell 16 has an area defined by a predetermined width and length. The width of the discharge cell 16 is defined between the centers of two adjacent partition walls 10 along the first and second electrodes 13 and 14. The length is defined between two adjacent middle portions each defined between the first electrodes 13 and the second electrode 14 of the next discharge cell. As shown by an imaginary line in FIG. 1, a pixel 17 can be composed by the blue, green, and red discharge cells 16*b*, 16*g*, and 16*r*. As one example, several dimensions and other parameters for designing the pixel 17 and each of the discharge cells 16 are shown in the following Table 1.

TABLE 1

| | |
|---|---|
| Dimension of Pixel | 1080 × 1080 $\mu m^2$ |
| Width of red discharge cell | 320 $\mu$m |
| Width of green discharge cell | 320 $\mu$m |
| Width of blue discharge cell | 440 $\mu$m |
| Electrode gap ($d_{ss}$) | 430 $\mu$m |
| Opposing discharge gap ($d_{sa}$) | 100 $\mu$m |
| Height of partition wall | 130 $\mu$m |
| Width of 1st and 2nd electrodes | 100 $\mu$m |
| Composition of mixture of gases | Ne (95%), Xe (5%) |
| Pressure of mixture of gases | 60 kPa |

In general, the blue, green, and red fluorescent layers 11*b*, 11*g*, and 11*r* each have different emission efficiencies. In particular, the blue fluorescent layer 11*b* has the emission efficiency less than those of the green and red fluorescent layers 11*g* and 11*r*. For this reason, the width of the blue discharge cell 16*b* according to the present invention is designed to be wider than those of the green and red fluorescent layers 11*g* and 11*r*, so that when all discharge cells 16 are turned on, the appropriate color temperature as a white light can be achieved.

In the panel 12 according to the embodiment, the distance between the first and second electrodes 13 and 14 is referred to as an "electrode gap $d_{SS}$". Also the height between the upper surface at the middle portion of the third electrode 15 and the lower surface of the protective layer 6 thereabove is referred to as an "opposing discharge gap $d_{Sa}$". The panel 12 according to the embodiment has the opposing discharge gap $d_{Sa}$ set to be less than the electrode gap $d_{SS}$, i.e., $d_{SS}>d_{Sa}$. Furthermore, a discharge space between the first electrode 13 and the third electrode 15 is referred to as a "first opposing discharge space", and a discharge space between the second electrode 14 and the third electrode 15 is referred to as a "second opposing discharge space".

In general, since two of aforementioned electrodes have discharge voltages (referred to as a "threshold discharge voltages") at which the discharge begins to be generated therebetween, several threshold discharge voltages may be defined as follows. The threshold discharge voltage $Vf_{SS}$ corresponds to that between the first and second electrodes 13 and 14. The threshold discharge voltage $Vf_{Sa}$ corresponds to that in the first (or second) opposing discharge space, when the third electrode 15 has an electric potential greater than that of the first electrode 13 (or second electrodes 14). The threshold discharge voltage $Vf_{aS}$ corresponds to that in the first (or second) opposing discharge space, when the third electrode 15 has the electric potential less than that of the first electrode 13 (or second electrodes 14).

Thus, the discharge generated by the threshold discharge voltage $Vf_{Sa}$ has a polarity opposite to that generated by the threshold discharge voltage $Vf_{aS}$. Meanwhile, when the threshold discharge voltage $Vf_{Sa}$ is applied, the discharge is generated and then extended from positively biased fluorescent layers 11 towards the negatively biased protective layer 6. A negative end of the discharge, i.e., negatively biased end, is formed adjacent the protective layer 6 with the secondary electron emission coefficient higher than that of fluorescent layers 11. Therefore, the protective layer 6 produces the greater number of the secondary electrons thereon. Since the secondary electrons reduces the threshold discharge voltage, the threshold discharge voltage $Vf_{Sa}$ is less than the threshold discharge voltage $Vf_{aS}$, i.e., $Vf_{Sa}<<Vf_{aS}$.

The threshold discharge voltage $Vf_{SS}$ is one where the distance $d_{SS}$ between the first and second electrodes 13 and 14 (the electrode gap) is 430 $\mu$m according to the embodiment. On the other hand, the discharging sustaining distance $d_p$ for sustaining the discharge according to the conventional surface discharge plasma display panel 1 falls within the range of 80 to 100 $\mu$m. Thus, the electrode gap $d_{SS}$ according to the embodiment is about five times greater than the discharging sustaining distance $d_p$. Therefore, if the driving methods of the conventional panel 1 were utilized for driving the panel 12 according to the present invention, the threshold discharge voltage $Vf_{SS}$ to trigger the discharge would be extremely high. As will be described in detail hereinafter, the present invention effectively utilizes the third electrode 15 to reduce the threshold discharge voltage $Vf_{SS}$ so that the discharge is sustained. Such sustained discharge is not the conventional "surface discharge", rather is appropriately referred to as a "counter discharge" between the first electrodes 13 and the third electrode 15, and between the second electrodes 14 and the third electrode 15. The counter discharge is generated in the vicinity of the fluorescent layers 11 causing them to excite effectively and then emit visual rays.

Now, referring to FIGS. 4 to 6, the driving method of the panel 12 according to the present invention is described hereinafter. The panel 12 can be driven to display an image with a gradation by separating a driving field period into a plurality of sub-field periods weighted based upon the binary notation. Each of the sub-field periods has an initialize period, an address period, and a sustain period. Each initialize period and address period may have a similar time duration, while each sustain period may have different time duration weighted by the binary number such as 1, 2, 4, 8, 16, 32, 64, and 128.

In order to display the panel 12, each electrode of the panel should be applied with predetermined driving signals in the initialize period, the address period, and the sustain period. FIG. 4 shows the driving signals to each electrode in the aforementioned periods.

Figures 4A, 4B, 4C, 4D:
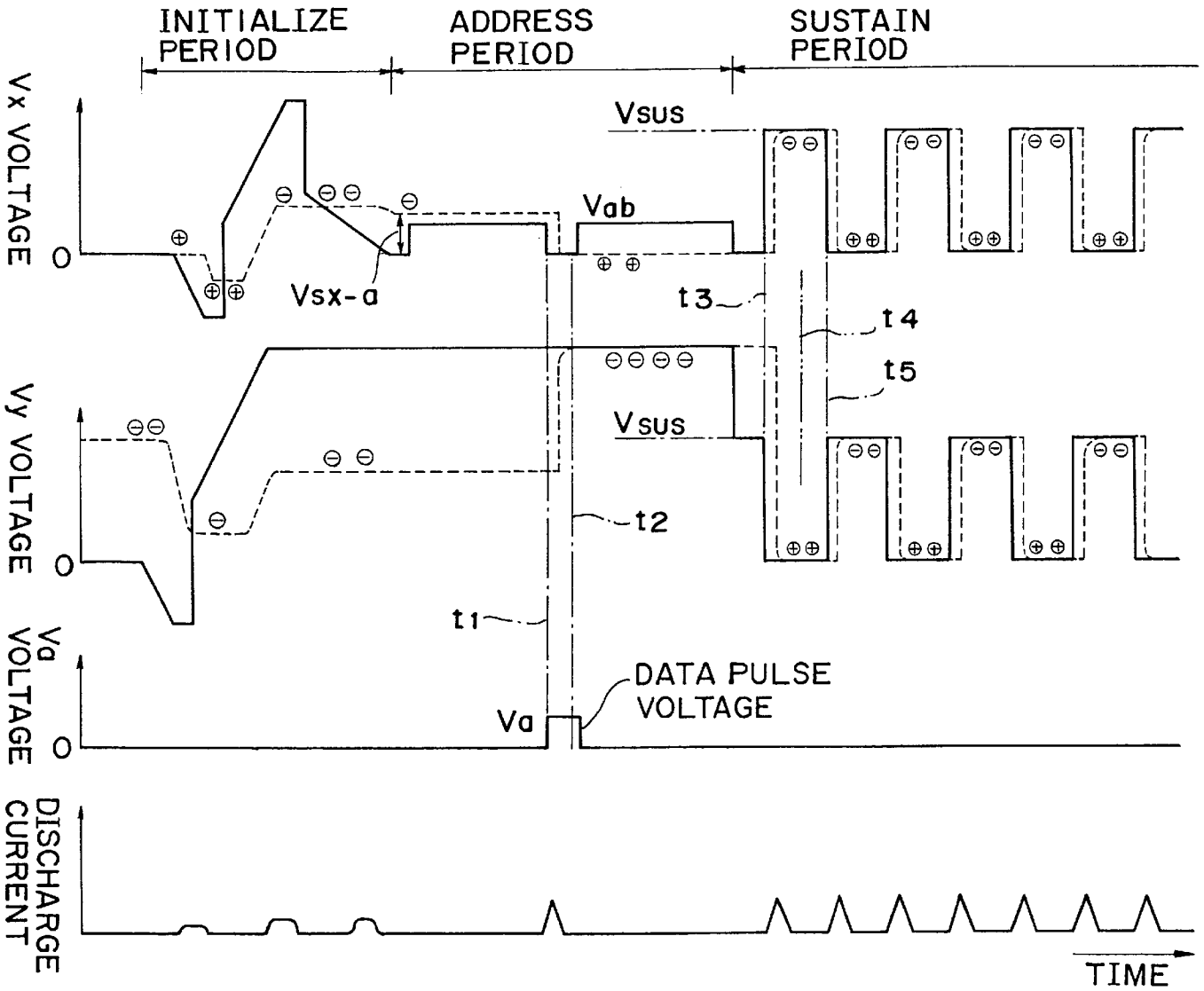
FIGS. 4A, 4B, and 4C are graphs showing characteristics of a signal voltage applied to a first, second, and third electrodes, respectively.
FIG. 4D is a graph showing characteristics of a signal current flown in accordance with the discharge according to the present invention.

FIGS. 4A, 4B, and 4C show signal voltages including a first signal voltage Vx applied to the first electrode 13, a second signal voltage Vy applied to the second electrode 14, and a third signal voltage Va applied to the third electrode 15, respectively. FIG. 4D shows a signal current flown in accordance with the discharge between the protective layer 6 and the fluorescent layer 11. Also, FIGS. 4A and 4B show, by the dashed lines, wall voltages accumulated on the dielectric layer 5 (or the protective layer 6) beneath the first and second electrode, respectively.

The wall voltages are generated on the dielectric layer 5 (or the protective layer 6) and the fluorescent layer 11 due to the wall charges accumulated in accordance with the discharge. The polarities of wall voltages shown in FIG. 4 are defined so that the difference between the applied voltages and the wall voltages represents an effective voltage in the opposing discharge spaces. The polarities of wall charges accumulated on the dielectric layer 5 (or the protective layer 6) beneath the first and second electrodes 13 and 14 are shown adjacent to the dashed lines in FIGS. 4A and 4B, respectively.

Now, referring to FIGS. 4A, 4B, and 4C, the condition of the discharge caused by the signal voltages applied during each above-mentioned period will be described hereinafter.

In the first stage during the initialize period, the first and second electrodes 13 and 14 are applied with first inclined voltages that decreases relative to the third electrode 15 so that a faint discharge is generated in the first and second opposing discharge spaces, thereby to form initial wall charges necessary for the subsequent discharge. Thus, the initial wall charges enhance to accumulate negative charges on the protective layer 6 with the relatively higher secondary electron emission coefficient in the following stage so that the discharge with the negative end adjacent protective layer 6 can be effectively generated.

In the middle stage during the initialize period, the first and second electrodes 13 and 14 are applied with second inclined voltages that increase relative to the third electrode 15 with comparatively large amplitude so that again the discharge is generated in the first and second opposing discharge spaces. As a result, the negative charge is accumulated on the protective layer 6.

In the last stage during the initialize period, the first electrode 13 is applied with a third inclined voltage that decreases relative to the third electrode 15. Thus, the discharge is caused between the first electrode 13 and the third electrode 15 so that the amount of the negative charge on the protective layer 6 beneath the first electrode 13 is adjusted.

While the inclined voltages are applied, the discharge current is kept flowing, and the voltage which is substantially similar to the discharge sustain voltage Vs is continuously applied in the first opposing discharge space. Therefore, at the end of the last stage in the initialize period, the voltage difference between the signal voltages and the wall voltages is approximately equal to the discharge sustain voltage Vs in the discharge space. The voltage applied in the first opposing discharge space at the end of the initialize period is denoted as "$Vs_{x-a}$" in FIG. 4.

During the address period, the first electrode 13 is applied with a bias voltage $V_{ab}$ so that the discharge is generated only in the selected discharge cells. The discharge cells are selected by sequentially applying the first electrode 13 with a negative pulse voltage. While the first electrode 13 is scanned, the third electrode 15 is applied with the positive data pulse voltage Va. Thus, at time $t_1$, the voltage of ($Vs_{x-a}$+Va) is applied in the first opposing discharge space between the first electrode 13 and the third electrode 15, and then the discharge begins in the first opposing discharge space. As mentioned above, since $V_{Sx-a}$ is substantially equal to the discharge sustain voltage across the first opposing discharge space, the relatively small voltage Va can cause the discharge to begin.

During the address period, since the second electrode 14 is applied with the positive voltage relative to the first electrode 13, the discharge generated in the first opposing discharge space moves towards the second opposing discharge space and extends along the third electrode 15. Eventually, at time $t_2$, the discharge is generated also in the second opposing discharge space. As a result, the polarity of the charge accumulated on the protective layer 6 beneath the first electrode 13 is reversed to that on the protective layer 6 beneath the second electrode 14.

Where no display data pulse voltage Va is applied, no discharge is generated in the first opposing discharge space so that the charge accumulated on the protective layer 6 beneath the first and second electrode 13 and 14 is kept to that at the last stage during the initialize period.

During the sustain period, the first and second electrodes 13 and 14 are alternately applied with a sustain pulse voltages having an amplitude of $V_{SUS}$. The sustain pulse voltage is applied to the second electrode 14 at time $t_3$ so that the discharge with the negative end adjacent to the second electrode 14 begins in the second opposing space. At this moment, the first electrode is applied with positive voltage against the second electrode 14 so that the above-mentioned discharge generated in the second opposing discharge space moves towards the first electrode 13 and extends along the third electrode 15. Eventually, at time $t_4$, the discharge is generated also in the first opposing discharge space. As a result, the polarities of the charge accumulated on the protective layer 6 beneath the first and second electrode 13 and 14 are reversed.

During the sustain period, the first and second electrodes 13 and 14 are repeatedly and alternately applied with the discharge sustain voltages in such a way as described above, for the time duration of the sustain period in each sub-field, which is weighted by the binary number.

Next, referring to FIGS. 5 and 6, the principle how the discharge generated in one of the opposing discharging surface extends towards the other opposing discharge space during the sustain duration will be described in detail hereinafter. FIGS. 5 and 6 are similar to that shown in FIG. 2, but slightly simplified cross sectional views of the panel of the embodiment, in which the protective layer 6 is eliminated. Those drawings show applied voltages, wall voltages, and conditions of the discharge plasma during the sustain duration.

Figure 5A:
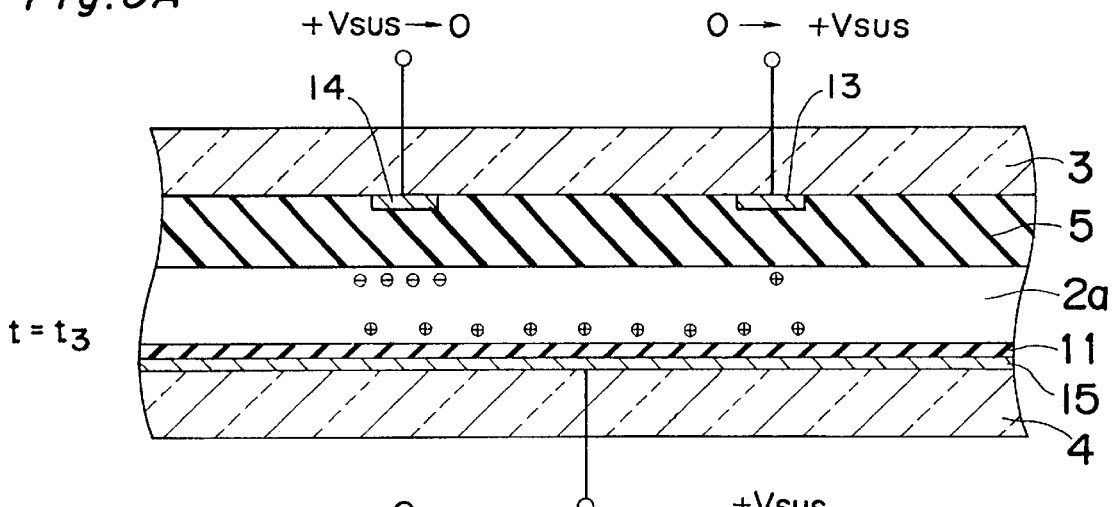
FIGS. 5A, 5B, and 5C are cross sectional views similar to that shown in FIG. 2, showing the condition of wall charges according to the present invention.

FIG. 5A shows the voltages applied to the electrodes 13, 14, and 15, and wall charges on both the dielectric layer 5 and the fluorescent layer 11 at time $t_3$. (See FIG. 4A.) At time $t_3$, the first electrode 13 is applied with an external-sustain voltage $V_{SUS}$ (also referred to as sustain pulse voltage $V_{SUS}$) and the second electrode 14 is ground to the earth. During the address period, the increased negative wall charge is accumulated on the is dielectric layer 5 beneath the second electrode 14. Thus, the second opposing discharge space has the effective voltage generated by the negative wall charge on the dielectric layer 5 beneath the second electrode 14. As mentioned above, the discharge is generated and then extended from positively biased fluorescent layer 11 towards the negatively biased dielectric layer 5. Thus, the discharge includes a positive end adjacent to the positively biased fluorescent layers 11 and a negative end adjacent to the negatively biased dielectric layer 5. In this instance, the discharge with the negative end adjacent to the dielectric layer 5 begins to be generated. The first opposing discharge space also has the effective voltage of about $V_{SUS}$. However, as described above, since the higher voltage is necessary to generate the discharge with the negative end adjacent to the fluorescent layer 11, no discharge can begin in first opposing discharge space. The positive wall charge is accumulated on the fluorescent layer 11 above the third electrode 15. This is because the second electrode 14 is applied with higher positive voltage, while the third electrode 15 with lower voltage draws and accumulates the positive charge on the fluorescent layer 11.

Figure 5B:
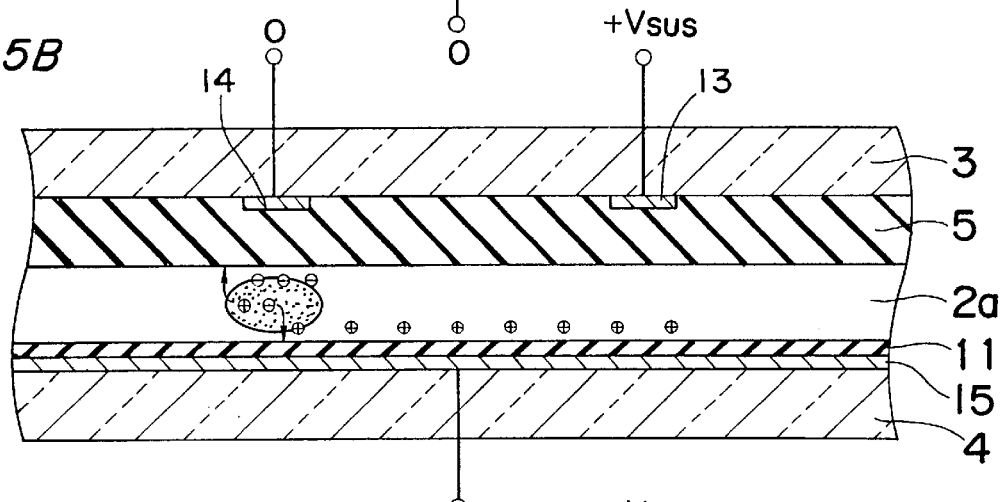

FIG. 5B shows the condition where the discharge has just begun in the second opposing discharge space. The voltage applied between the second and third electrodes 14 and 15 causes the discharge to generate the wall voltage on the fluorescent layer 11 and the dielectric layer 5 due to the wall charge accumulated thereon, until the wall voltages counteracts the applied voltage so as to cease the discharge. The fluorescent layer 11 above the third electrode 15 has the dielectric constant less than that of the dielectric layer 5 beneath the second electrode 14. Therefore, the positive wall charge can be accumulated more quickly on the fluorescent layer 11 than that on the dielectric layer 5. Also, the first electrode 13 is applied with the positive external-sustain voltage $V_{SUS}$ relative to the third electrode 15. As a result, the positive end of the discharge horizontally moves towards the first opposing discharge space so as to have the negative charges on the dielectric layer 5 couple with positive wall charge on the dielectric layer 5.

Figure 5C:
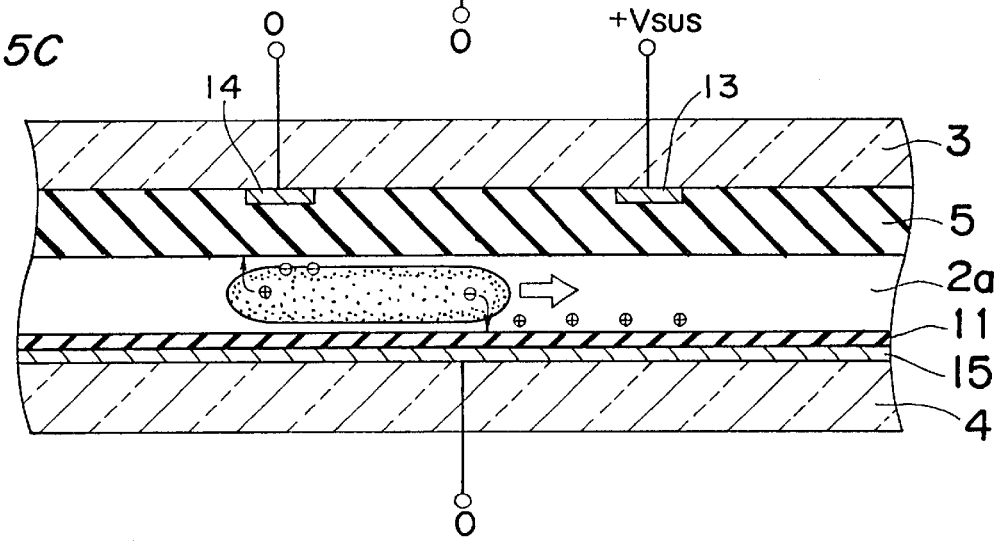

FIG. 5C shows the positive end of the discharge, which is horizontally moving. Thus, the positive end of the discharge extends towards the first electrode 13 so as to counteract the positive wall charge accumulated on the fluorescent layer 11.

Figure 6A:
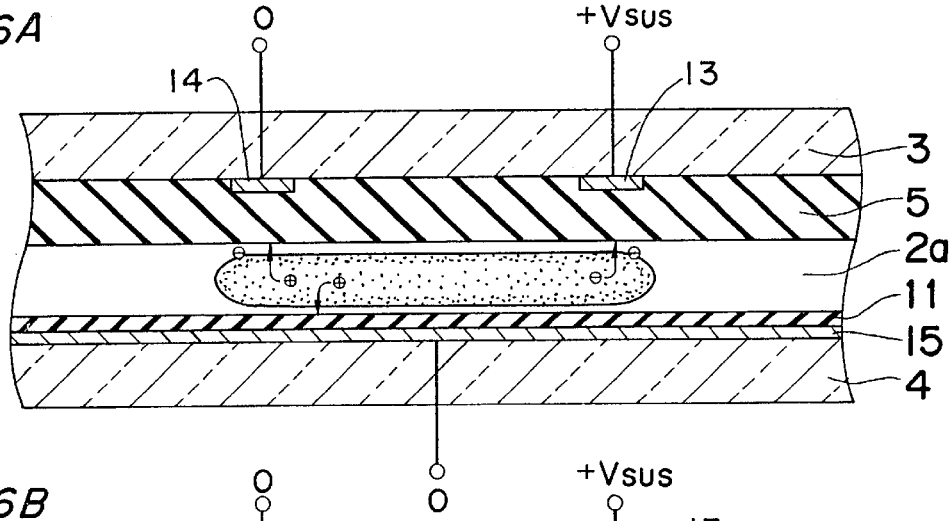
FIGS. 6A, 6B, and 6C are another cross sectional views similar to that shown in FIG. 2, showing the condition of wall charges according to the present invention.

FIG. 6A shows the positive end of the discharge, which reaches the first opposing discharge space at time $t_4$. (See FIG. 4.) The discharge with the condition of a discharge plasma as shown in FIG. 6A is referred to as a "positive column discharge", which is generated between the first and second opposing discharge space, and emits a powerful ultra-violet rays.

Figure 6B:
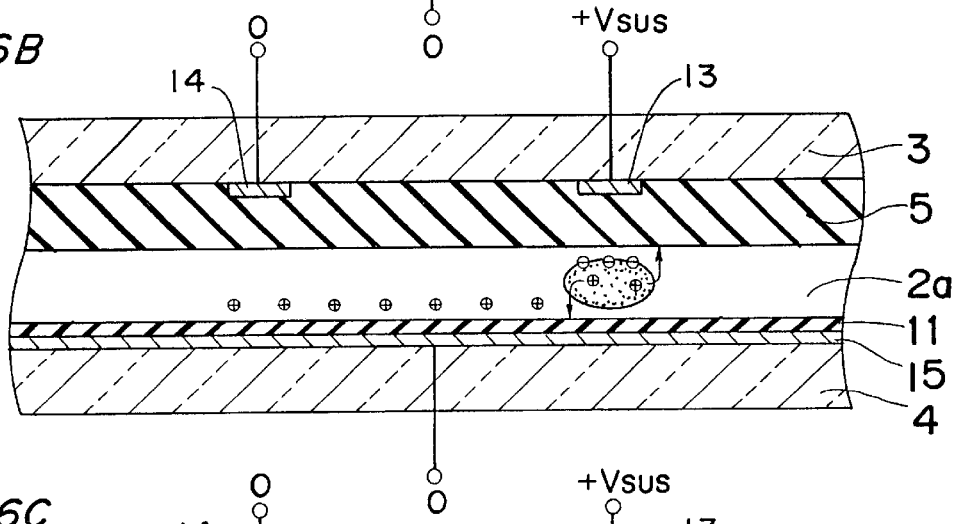

FIG. 6B shows the condition of the discharge just prior to the discharge ceases. A series of the aforementioned discharges also accumulates the increased negative wall charge on the dielectric layer 5 beneath the first electrode 13 and the positive wall charge on the dielectric layer 5 beneath the second electrode 15, respectively. Thus, the series of the aforementioned discharge causes the increased negative wall charge accumulated on the dielectric layer 13 beneath the first electrode 13, indicating as a "memory" that the positive column discharge has been sustained.

Figure 6C:
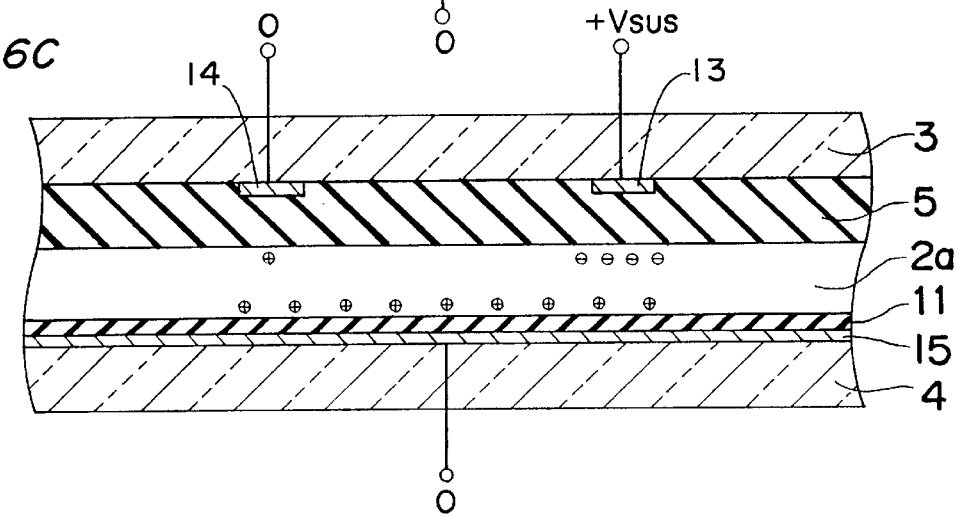

FIG. 6C shows the condition of the discharge after the discharge ceases, in which the effective voltages in the opposing discharge spaces are counteracted due to the charges accumulated on the dielectric layer 5 and the fluorescent layer 11. Thus, the negative wall charge is accumulated on the dielectric layer 5 beneath the first electrode 13, which is applied with the positive external-sustain voltage $V_{SUS}$. While the positive wall charge is accumulated on the fluorescent layer 11 above the third electrode 15 and on the dielectric layer 5 beneath the second electrode 14. As can be seen from FIGS. 5A and 6C, the conditions of the discharge are reversed. In other words, wall charges accumulated beneath the first and second electrode 13 and 14 have the same amount of charge but the opposite polarities.

Therefore, when the panel as shown in FIG. 6C has the second electrode 14 applied with the external-sustain voltage $V_{SUS}$, and the first electrode 13 ground to the earth, thus, the series of discharge can be repeated.

Again, a series of discharge along with the positive column discharge is memorized as the increased negative wall charge on the dielectric layer 5 at which the positive end of the discharge ceases. In other words, when the series of the discharge ceases in the second opposing discharge space, and the increased negative wall charge is accumulated on the dielectric layer 5 beneath the second electrode 14, then the next series of discharge begins at the second opposing discharge space, and reaches and ceases in the first opposing discharge space. On the contrary, the wall voltage of the another opposing discharge space in which the discharge begins is almost eliminated, when the series of discharge ceases, as shown in FIGS. 5A and 6*c*. The another opposing discharge space loses the condition due to the prior discharge.

The panel according to the present invention has the extended gap $d_{SS}$, corresponding to the distance between the first and second electrodes 13 and 14 as shown in FIG. 2, and generates the positive column discharge so that the high emission efficiency can be achieved. However, inadvantageously, the longer gap $d_{SS}$ needs the higher discharge voltage.

Figure 7:
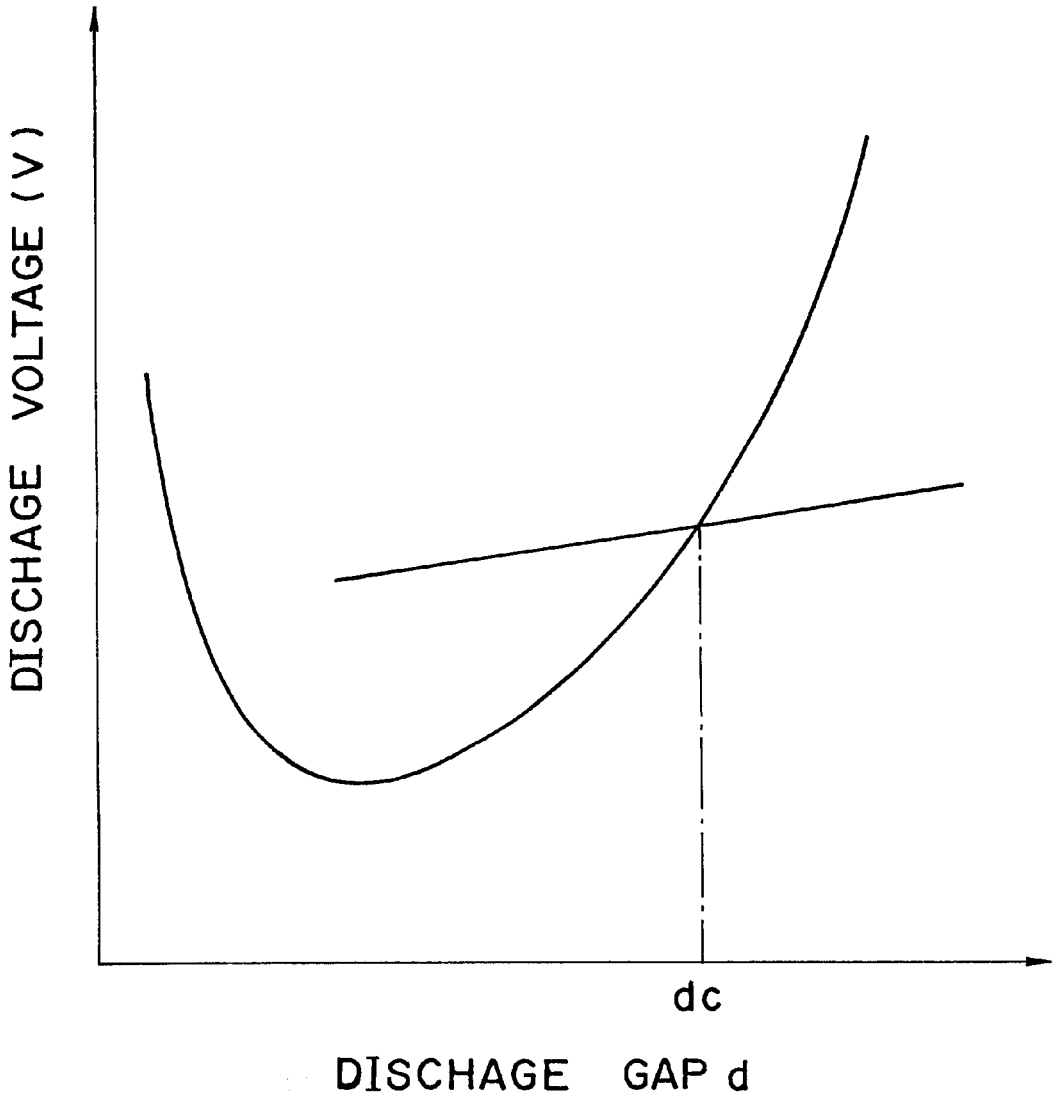
FIG. 7 is a graph showing the relationship between the discharge gap and the discharge voltage.
Figure 8A:
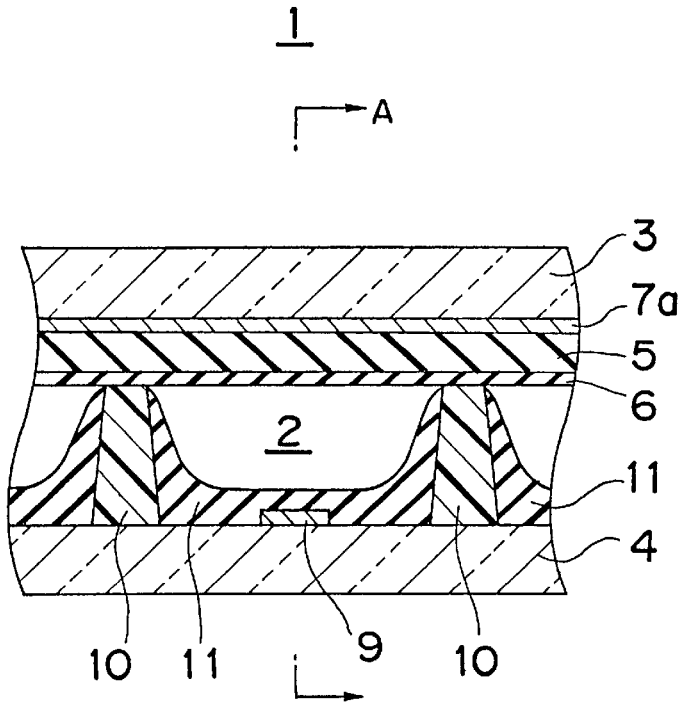
Fig.8A PRIOR ART
FIGS. 8A and 8B are partially fragmentary top views of the conventional panel.
Figure 8B:
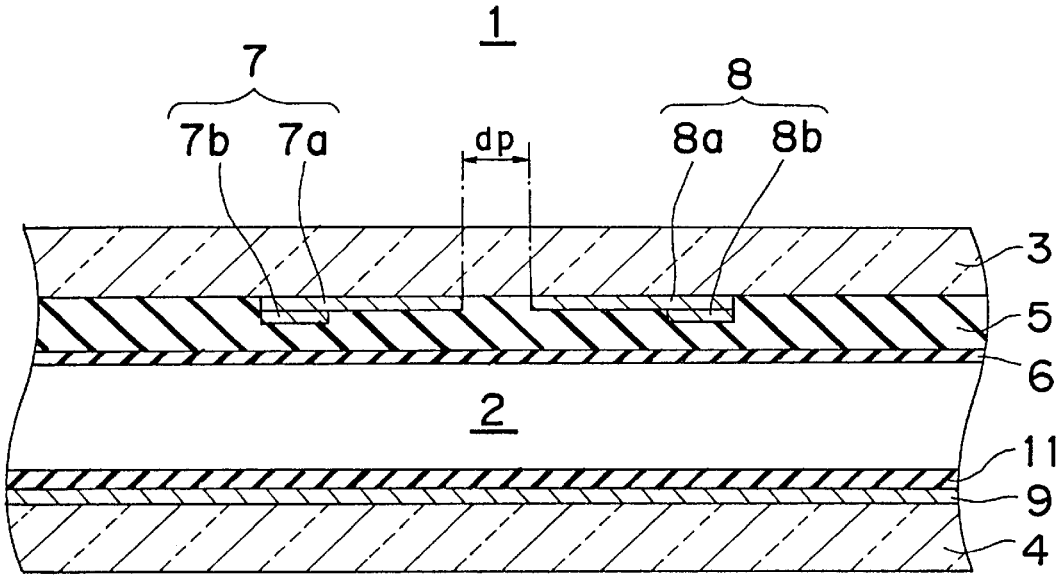
Fig.8B PRIOR ART

FIG. 7 shows, in general, a relationship between the discharge voltage and the discharge gap d. In particular, a curve P follows the Paschen's law showing the relationship between the discharge voltage and the discharge gap d, which corresponds to the distance between the first and second electrodes 13 and 14, when the discharge is generated in the conventional way without using the third electrode 15. Thus, the discharge voltage corresponds to the discharge sustain voltage for the conventional surface discharge type panel. On the contrary, a curve Q shows the relationship between the discharge voltage and the aforementioned discharging distance (gap $d_{SS}$) according to the present invention, when the series of discharge extends between the opposing discharge spaces by using the third electrode 15 and the fluorescent layer 11 thereon.

Again, the curve P is the Paschen's curve so that the discharge voltage has a minimum point, and it sharply increase as the distance d is longer. Meanwhile, the curve Q shows that the discharge voltage is kept substantially similar to one in the opposing discharge spaces, and that its increase is slight even where the gap d is longer.

Although the discharge voltage according to the curve P is less than that according to the curve Q when the gap d is less than predetermined gap dc, the former is more than the latter when the distance d is longer than dc. Thus, the third electrode 15 and the fluorescent layer 11 reduce the discharge voltage. The gap dc is referred to as a specific discharging distance, which is substantially equal to the opposing discharge gap $d_{Sa}$.

Therefore, when the gap $d_{SS}$ is longer than the specific discharging distance dc, the discharge can be sustained with a relative low discharge voltage with a support of the third electrode 15 and the fluorescent layer 11 so as to generate the positive column discharge, thereby to achieve the greater emitting efficiency. The positive column discharge represents, in general, a filament-like discharge generated in the extended space between the first and second opposing discharge spaces.

Next, an example of the panel according to the embodiment will be described hereinafter.

Each pixel in the panel according to the embodiment, comprises the blue, green, and red discharge cells 16*b*, 16*g*, and 16*r* provided with the blue, green, and red fluorescent layers 11*b*, 11*g*, 11*r*, which are made of $BaMgAl_{10}O_{17}$;Eu, $Zn_2SiO_4$;Mn, and (Y2Gd)$BO_3$;Eu, respectively. Also, as described at Table 1, the blue, green, and red discharge cells 16*b*, 16*g*, and 16*r* are designed to have the widths of 440 $\mu$m, 320 $\mu$m, and 320 $\mu$m, respectively. Then, a white light which is a combination of the above-mentioned three color lights has a color temperature of 10,000 K on the black-body radiation track in the chromaticity diagram. Thus, a high quality of the white light can be produced.

When the panel according to the embodiment has above-defined threshold discharge voltages, such as $Vf_{SS}$, $Vf_{Sa}$, $Vf_{aS}$, and $Vf_{SSA}$ of 700V, 250V, 350V, and 450V, respectively, also, $V_{SUS}$ of 270V, and a time period from $t_3$ to $t_5$ of 2.5 $\mu$s, then the panel can be stably driven. While the conventional panel has the discharge sustain gap of 80 through 100 $\mu$m, the panel according to the present invention has the corresponding gap $d_{SS}$ of 430 $\mu$m, which is four times longer than that of the conventional one. If the conventional driving method was applied to the panel according to the present invention, the sustaining voltage more than about 400 V would be required, so that it would be difficult to drive the panel in a stable manner. However, the panel according to the present invention can generate the discharge in one of the opposing spaces and extend the discharge towards the other opposing space to produce the positive column discharge so that the panel can be stably driven with a relatively low voltage.

When a varying rate of inclined voltages during the initialize period are adjusted to 5 V/$\mu$s, and the addressing pulse voltage Va and the sustain pulse voltage $V_{SUS}$ to be 80 V and 270 V, respectively, the panel designed as described in Table 1 can be reliably driven. Thus, by the application of the signal voltage having the inclined voltage with the gradually varying rate during the initialize period, as described in FIG. 4, the effective voltage applied in the first opposing discharge space can be adjusted to that substantially the same as the discharge sustain voltage at the end of the initialize period. Thus, an operation margin during the address period can be secured sufficiently, thereby driving the panel in the stable manner.

Furthermore, several tests were conducted for various panels and revealed that when the varying rate of inclined voltages was adjusted for the initialize period to be 10 V/$\mu$s, then the similar effect as described above could be achieved. Also, the stable address operation can be realized unless the varying rates of the inclined voltages during the initialize period are zero. However, since each field has a time duration of about 16 ms, the practical varying rate of inclined voltages are limited to 0.5 V/$\mu$s or more for displaying an image with 256 gradations.

Also, the panel according to the present invention was established that the emission efficiency of about 21 m/W could achieve. Meanwhile, the conventional panel achieves the emission efficiency of about 11 m/W. Therefore, the panel according to the present invention improves the emission efficiency double comparing to the conventional one.

As described above, the panel according to the present invention has the extended gap $d_{SS}$ between the first and second electrodes 13 and 14, so that the emission efficiency can be substantially improved. Also the blue discharge cell has the width greater than those of the green and red discharge cells so that the AC type plasma display panel can emit white light having the high color temperature and the high performance display.

The AC type plasma display panel according to the present invention has been described above as the panel, which is driven during the address periods and individual sustain periods. This is referred to as an address-sustain separation type driving method. In addition, the AC type plasma display panel can achieve the same effect by utilizing another addressing method. The signal voltages applied during the initialize and address periods may be different from the signal voltages as indicated above, but the wall charges should be selectively generated in accordance with the input of the data pulse (image signal data). For example, the third electrode 15 may be applied with a signal voltage, which has a gradually varying inclined portion during the initialize period.

What is claimed is:

1. A driving method of an AC type plasma display panel comprising a first substrate including a plurality of pairs of first and second electrodes extending parallel to each other on a first surface of the first substrate, and a dielectric layer covering the first surface and being on the first and second electrodes; and a second substrate including a plurality of third electrodes extending on a second surface of the second substrate in a direction crossing the first and second electrodes, and a plurality of partition walls partitioning each of the third electrodes from a remainder of the third electrodes, wherein the first and second substrates are arranged so that the first and second surfaces oppose each other, said driving method comprising:

driving the AC type plasma display panel so that an opposing discharge generated in a first opposing discharge space between one of the first electrodes and one of the third electrodes moves towards a second opposing discharge space between one of the second electrodes and the one of the third electrodes, and extends along the one of the third electrodes, while preventing a surface discharge between one of the first electrodes and one of the second electrodes, wherein voltages applied during a sustain period are less than a minimum voltage necessary for generating a surface discharge between the one of the first electrodes and the one of the second electrodes.

2. The driving method according to claim 1, wherein the AC type plasma display panel further comprises blue, green, and red fluorescent layers provided respectively on the third electrodes between adjacent partition walls, the blue, green, and red fluorescent layers emitting blue, green, and red visual rays, respectively, in accordance with ultraviolet rays generated by the opposing discharge, and wherein the adjacent partition walls provided on either side of at least one of the blue, green, and red fluorescent layers have a width different from others.

3. The driving method according to claim 2, wherein the adjacent partition walls provided on either side of the blue fluorescent layer have the width which is greater than widths of the adjacent partition walls on either side of the green and red fluorescent layers.

4. A driving method of an AC type plasma display panel comprising a first substrate including a plurality of pairs of first and second electrodes extending parallel to each other on a first surface of the first substrate, and a dielectric layer covering the first surface and being on the first and second electrodes; and a second substrate including a plurality of third electrodes extending on a second surface of the second substrate in a direction crossing the first and second electrodes, and a plurality of partition walls partitioning each of the third electrodes from a remainder of the third electrodes, wherein the first and second substrates are arranged so that the first and second surfaces oppose each other, said driving method comprising:

a) applying a predetermined voltage between one of the first electrodes and one of the second electrodes so that the one of the second electrodes is positively biased relative to the one of the first electrodes, and applying a data pulse voltage to one of the third electrodes during an address period; and b) applying voltages during a sustain period so that after an opposing discharge begins in a second opposing discharge space between the one of the second electrodes and the one of the third electrodes, the opposing discharge moves towards a first opposing discharge space between the one of the first electrodes and the one of the third electrodes, and extends along the one of the third electrodes, while preventing a surface discharge between one of the first electrodes and one of the second electrodes, wherein the voltages applied during the sustain period are less than a minimum voltage necessary for generating a surface discharge between the one of the first electrodes and the one of the second electrodes.

5. The driving method according to claim 4, further comprising:

c) applying voltages so that after the opposing discharge begins in the first opposing discharge space, the opposing discharge moves towards the second opposing discharge space, and extends along the one of the third electrodes.

6. The driving method according to claim 5, wherein said step b) and said step c) are repeatedly and alternately performed so as to sustain the opposing discharge.

7. The driving method according to claim 4, further comprising:

d) applying a signal voltage with a gradually varying inclined portion to the one of the first electrodes, the one of the second electrodes, or the one of the third electrodes during an initialize period prior to the address period.

8. The driving method according to claim 5, further comprising:

d) applying a signal voltage with a gradually varying inclined portion to the one of the first electrodes, the one of the second electrodes, or the one of the third electrodes during an initialize period prior to the address period.

9. The driving method according to claim 6, further comprising:

d) applying a signal voltage with a gradually varying inclined portion to the one of the first electrodes, the one of the second electrodes, or the one of the third electrodes during an initialize period prior to the address period.

10. The driving method according to claim 7, wherein the inclined portion has a varying rate of 10 V/$\mu$s or less.

11. The driving method according to claim 8, wherein the inclined portion has a varying rate of 10 V/$\mu$s or less.

12. The driving method according to claim 9, wherein the inclined portion has a varying rate of 10 V/$\mu$s or less.

13. A driving method of an AC type plasma display panel-comprising a first substrate including a plurality of pairs of first and second electrodes extending parallel to each other on a first surface of the first substrate, and a dielectric layer covering the first surface and being on the first and second electrodes; and a second substrate including a plurality of third electrodes extending on a second surface of the second substrate in a direction crossing the first and second electrodes, and a plurality of partition walls partitioning each of the third electrodes from a remainder of the third electrodes, wherein the first and second substrates are arranged so that the first and second surfaces oppose each other, said driving method comprising:

driving the AC type plasma display panel so that an opposing discharge generated in a first opposing discharge space between one of the first electrodes and one of the third electrodes moves towards a second opposing discharge space between one of the second electrodes and the one of the third electrodes, and extends along the one of the third electrodes, while preventing a surface discharge between one of the first electrodes and one of the second electrodes, wherein an electrode gap between the first and second electrodes of each pair of first and second electrodes is greater than an opposing discharge gap between each pair of first and second electrodes and the third electrodes.

14. The driving method according to claim 13, wherein the AC type plasma display panel further comprises blue, green, and red fluorescent layers provided respectively on the third electrodes between adjacent partition walls, the blue, green, and red fluorescent layers emitting blue, green, and red visual rays, respectively, in accordance with ultraviolet rays generated by the opposing discharge, and wherein the adjacent partition walls provided on either side of at least one of the blue, green, and red fluorescent layers have a width different from others.

15. The driving method according to claim 14, wherein the adjacent partition walls provided on either side of the blue fluorescent layer have the width which is greater than widths of the adjacent partition walls on either side of the green and red fluorescent layers.

16. A driving method of an AC type plasma display panel comprising a first substrate including a plurality of pairs of first and second electrodes extending parallel to each other on a first surface of the first substrate, and a dielectric layer covering the first surface and being on the first and second electrodes; and a second substrate including a plurality of third electrodes extending on a second surface of the second substrate in a direction crossing the first and second electrodes, and a plurality of partition walls partitioning each of the third electrodes from a remainder of the third electrodes, wherein the first and second substrates are arranged so that the first and second surfaces oppose each other, said driving method comprising:

a) applying a predetermined voltage between one of the first electrodes and one of the second electrodes so that the one of the second electrodes is positively biased relative to the one of the first electrodes, and applying a data pulse voltage to one of the third electrodes during an address period; and b) applying voltages during a sustain period so that after an opposing discharge begins in a second opposing discharge space between the one of the second electrodes and the one of the third electrodes, the opposing discharge moves towards a first opposing discharge space between the one of the first electrodes and the one of the third electrodes, and extends along the one of the third electrodes, while preventing a surface discharge between one of the first electrodes and one of the second electrodes, wherein an electrode gap between the first and second electrodes of each pair of first and second electrodes is greater than an opposing discharge gap between each pair of first and second electrodes and the third electrodes.

17. The driving method according to claim 16, further comprising:

c) applying voltages so that after the opposing discharge begins in the first opposing discharge space, the opposing discharge moves towards the second opposing discharge space, and extends along the one of the third electrodes.

18. The driving method according to claim 17, wherein said step b) and said step c) are repeatedly and alternately performed so as to sustain the opposing discharge.

19. The driving method according to claim 16, further comprising:

d) applying a signal voltage with a gradually varying inclined portion to the one of the first electrodes, the one of the second electrodes, or the one of the third electrodes during an initialize period prior to the address period.

20. The driving method according to claim 17, further comprising:

d) applying a signal voltage with a gradually varying inclined portion to the one of the first electrodes, the one of the second electrodes, or the one of the third electrodes during an initialize period prior to the address period.

21. The driving method according to claim 18, further comprising:

d) applying a signal voltage with a gradually varying inclined portion to the one of the first electrodes, the one of the second electrodes, or the one of the third electrodes during an initialize period prior to the address period.

22. The driving method according to claim 19, wherein the inclined portion has a varying rate of 10 V/$\mu$s or less.

23. The driving method according to claim 20, wherein the inclined portion has a varying rate of 10 V/$\mu$s or less.

24. The driving method according to claim 21, wherein the inclined portion has a varying rate of 10 V/$\mu$s or less.

* * * * *